US011303995B2

(12) United States Patent
Pepin et al.

(10) Patent No.: US 11,303,995 B2
(45) Date of Patent: Apr. 12, 2022

(54) ADAPTABLE WAVEGUIDES

(71) Applicant: Bose Corporation, Framingham, MA (US)

(72) Inventors: David L. Pepin, Framingham, MA (US); Benjamin C. Lippitt, Worcester, MA (US); Richard J. Carbone, Sterling, MA (US); John W. Mazejka, Charlton, MA (US); Greg J. Zastoupil, Norh Grafton, MA (US); James Platek, Framingham, MA (US); Gabriel Lloyd Murray, Shrewsbury, MA (US)

(73) Assignee: Bose Corporation, Framingham, MA (US)

( * ) Notice: Subject to any disclaimer, the term of this patent is extended or adjusted under 35 U.S.C. 154(b) by 0 days.

(21) Appl. No.: 17/122,028

(22) Filed: Dec. 15, 2020

(65) Prior Publication Data

US 2021/0185432 A1 Jun. 17, 2021

Related U.S. Application Data

(60) Provisional application No. 62/948,535, filed on Dec. 16, 2019.

(51) Int. Cl.

| | |
|---|---|
| ***H04R 1/34*** | (2006.01) |
| ***H04R 1/02*** | (2006.01) |
| ***H04R 1/28*** | (2006.01) |
| ***H04R 1/30*** | (2006.01) |

(52) U.S. Cl.
CPC ..... *H04R 1/345* (2013.01); *H04R 1/025* (2013.01); *H04R 1/2807* (2013.01); *H04R 1/30* (2013.01)

(58) Field of Classification Search
CPC ..... H04R 1/345; H04R 1/025; H04R 1/2807; H04R 1/30
USPC ..... 381/160
See application file for complete search history.

(56) References Cited

U.S. PATENT DOCUMENTS

| | | | |
|---|---|---|---|
| 2004/0131217 | A1 | 7/2004 | Opie et al. |
| 2006/0062402 | A1 | 3/2006 | Heil |
| 2017/0180846 | A1 | 6/2017 | Lippitt et al. |

FOREIGN PATENT DOCUMENTS

| | | | |
|---|---|---|---|
| EP | 0988772 | A1 | 3/2000 |
| KR | 101714960 | B1 | 3/2017 |

OTHER PUBLICATIONS

EP Search Report dated Apr. 9, 2021 for EP20213681.8.
EP Search Report dated Aug. 23, 2021 for EP20213681.8.

*Primary Examiner* — Sean H Nguyen
(74) *Attorney, Agent, or Firm* — Bose Corporation

(57) ABSTRACT

A waveguide assembly for a loudspeaker is provided. The waveguide assembly includes a plurality of panels and a plurality of trays, which together at least partially defines a waveguide. One or more of the panels are arranged to be movable relative to the trays to adjust a coverage pattern of the waveguide.

18 Claims, 19 Drawing Sheets

ADAPTABLE WAVEGUIDES

CROSS REFERENCE TO RELATED APPLICATIONS

This application claims a benefit under 35 USC § 119 to U.S. Provisional Patent Application Ser. No. 62/948,535, titled ADAPTABLE WAVEGUIDES filed on Dec. 16, 2019, which is incorporated herein in its entirety for all purposes.

TECHNICAL FIELD

This disclosure generally relates to loudspeakers. More particularly, the disclosure relates to a loudspeaker having an adjustable waveguide for controlling audio output coverage patterns.

BACKGROUND

There is an increasing demand for high performance, dynamic portable loudspeakers. In particular applications such as touring, or in rental loudspeaker applications, loudspeakers must be portable and adaptable for different venues and uses. While waveguides can be used to adjust the coverage pattern from loudspeakers according to particular circumstances, carrying many sets of waveguides can be logistically challenging and result in time-consuming setup and breakdown of loudspeaker configurations. Additionally, previously developed adjustable loudspeakers have proven cumbersome for users due to highly complex moving parts.

SUMMARY

All examples and features mentioned below can be combined in any technically possible way.

In one aspect, a waveguide assembly for a loudspeaker is provided. The waveguide assembly includes a plurality of panels and a plurality of trays, which together at least partially defines a waveguide. One or more of the panels are arranged to be movable relative to the trays to adjust a coverage pattern of the waveguide.

Implementations may include one of the following features, or any combination thereof.

In some implementations, the waveguide assembly also includes a coupling member for acoustically coupling one or more electro-acoustic transducers to the waveguide.

In certain implementations, the plurality of panels includes a pair of fixed panels that remain stationary relative to the trays and a plurality of displaceable panels that are movable relative to the trays to allow adjustment of the coverage pattern.

In some cases, the displaceable panels at least partially define a primary flare (having a first expansion rate) of the waveguide, and the fixed panels at least partially define a secondary flare (having a second expansion rate, different from the first expansion rate) of the waveguide.

In certain cases, the displaceable panels include a pair of front panels and a pair of rear panels. Each of the front panels has a first end that is rotatably coupled to a pair (two) of the trays, and a second, free end that is moveable relative to the trays. Each of the second panels has a first end that is rotatably coupled to a pair (two) of the trays, and a second, free end that this moveable relative to the trays. The displaceable panels are moveable (pivotable) between a first orientation providing a first coverage pattern and a second orientation providing a second coverage pattern that is narrower than the first coverage pattern.

In some examples, in the first orientation, each of the free ends of the front panels abuts a first surface at the free end of an associated one of the rear panels, and, in the second orientation, each of the fee ends of the front panels abuts a second surface at the free end of the associated one of the rear panels.

In certain examples, the waveguide assembly also includes a plurality of springs (e.g., torsion springs) which bias the displaceable panels towards the first orientation.

In some implementations, the plurality of panels includes a first plurality of panels that form a first sidewall of the waveguide, and a second plurality of panels that form a second sidewall of the waveguide.

In certain implementations, each of the first and plurality of panels includes a rear panel, a main panel, and a front panel. The main panels at least partially define a primary flare of the waveguide, and the front panels at least partially defines a secondary flare of the waveguide.

In some cases, in each of the first and second plurality of panels, the front panel is coupled to the main panel at a first hinge and the main panel is coupled to the rear panel a second hinge.

In certain cases, the first and second pluralities of panels are moveable between a first orientation providing a first coverage pattern and a second orientation providing a second coverage pattern that is narrower than the first coverage pattern by sliding the panels fore and aft relative to the trays.

In some examples, side edges of the panels are slidably received in tracks defined by the trays, and wherein the panels are moveable between the first orientation and the second orientation by sliding the panels fore and aft relative to the trays.

In certain examples, the first and second pluralities of panels may be positioned in a third orientation that provides a third coverage pattern that is narrower than the first coverage pattern and wider than the second coverage pattern by sliding the panels fore and aft relative to the trays.

In some implementations, the panels are removably received between the trays.

In certain implementations, the panels are configured to be removed, reoriented, and reinserted to adjust the coverage pattern of the waveguide.

In some cases, each of the panels includes a first surface that defines a first coverage angle and a second surface that defines a second coverage angle.

In certain cases, the panels are configured to be arranged in a first orientation in which the respective first surfaces of the left and right panels face each other to provide a first coverage pattern and a second orientation in which the respective second surfaces of the left and right panels face each other to provide a second coverage pattern that is narrower than the first coverage pattern.

DETAILED DESCRIPTION

Figure 1A:
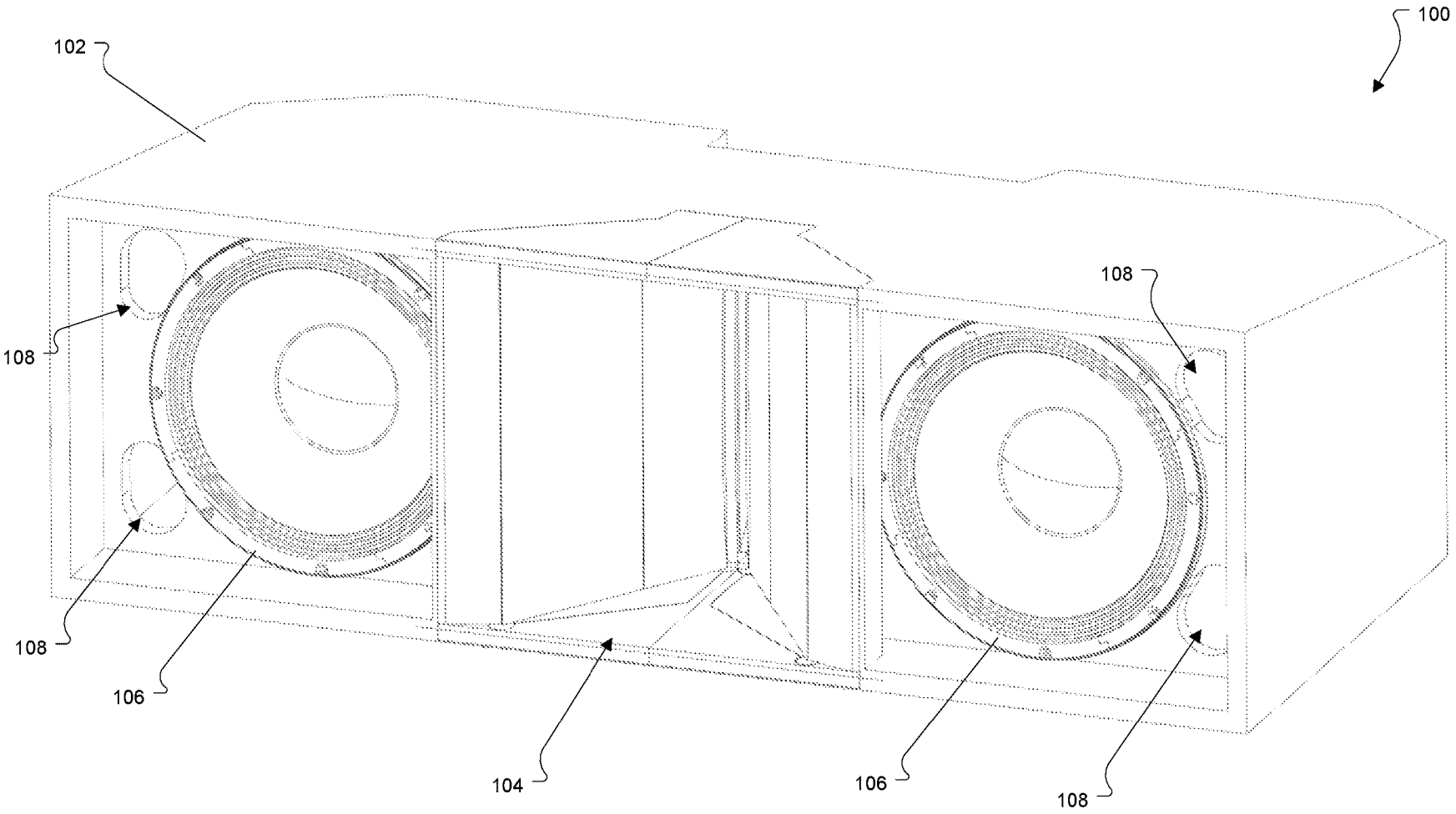
FIG. 1A is a perspective view of a loudspeaker shown from the front, top, and right side.
Figure 1B:
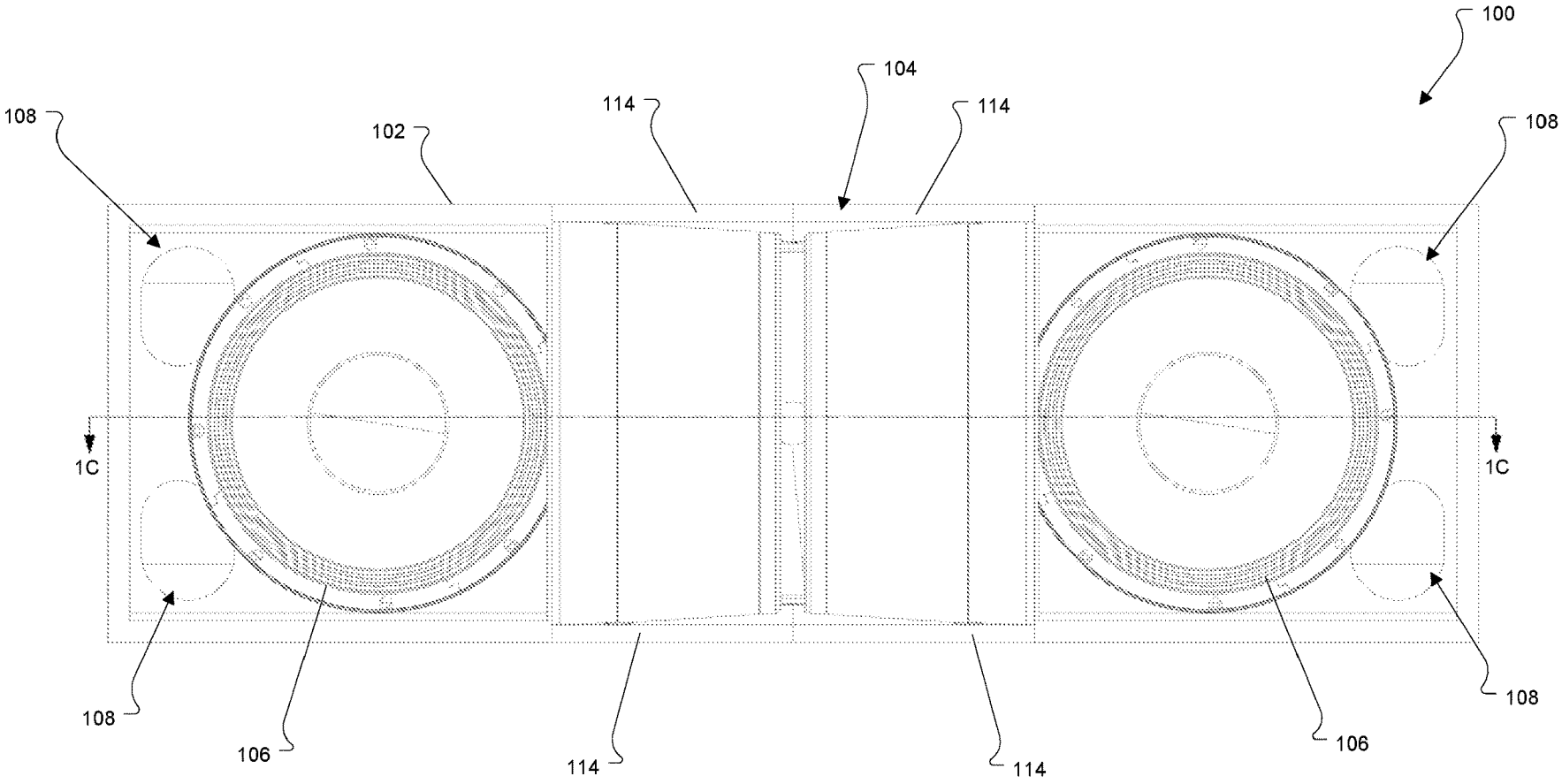
FIG. 1B is a front view of the loudspeaker of FIG. 1A.

This disclosure is based, at least in part, on the realization that an adjustable waveguide can be beneficially incorporated into a loudspeaker to control the loudspeaker's coverage pattern. For example, a loudspeaker having an adjustable waveguide can provide multiple desired coverage patterns in certain applications, such as in portable speaker, touring speaker and/or rental speaker applications.

Commonly labeled components in the FIGURES are considered to be substantially equivalent components for the purposes of illustration, and redundant discussion of those components is omitted for clarity. Numerical ranges and values described according to various implementations are merely examples of such ranges and values, and are not intended to be limiting of those implementations. In some cases, the term "approximately" is used to modify values, and in these cases, can refer to that value +/− a margin of error, such as a measurement error, which may range from up to 1-5 percent.

As described herein, conventional approaches to develop high performance, dynamic portable loudspeakers have failed due to, among other things, the complexity of the speaker parts, high costs, and diminished performance. In contrast to conventional systems, the loudspeakers disclosed according to various implementations have a waveguide coupled to the loudspeaker box that includes at least one adjustable panel for modifying the loudspeaker's coverage pattern.

With reference to FIGS. 1A through 1D, a loudspeaker 100 includes an enclosure 102 that supports a waveguide assembly 104, a pair of low-frequency transducers 106, and a plurality of bass reflex ports 108. The enclosure 102 includes plurality of walls that together at least partially define an acoustic cavity 110. The enclosure 102 may be formed of a rigid material such as plywood, metal, or plastic.

The low-frequency transducers 106 are mounted to a front wall of the enclosure 102 and are arranged such that respective first radiating surfaces of the low-frequency transducers 106 radiate acoustic energy outwardly from the front wall and respective second radiating surfaces of the low-frequency transducers 106 radiate acoustic energy into the acoustic cavity 110 which is acoustically coupled to the bass reflex ports 108.

The waveguide assembly 104 includes a plurality of panels 112*a*, 112*b*-1, 112*b*-2 (collectively "112") and a plurality of trays 114. Together the panels 112 and the trays 114 at least partially define a waveguide. The trays 114 may be coupled to the enclosure 102, e.g., via fasteners or adhesive. The waveguide assembly 104 also includes a coupling member 116 which supports a high-frequency transducer 118 within the acoustic cavity 110. In the illustrated examples, the high-frequency transducer 118 is coupled, both mechanically and acoustically, to the coupling member 116 by a horn segment 120. While a single high-frequency transducer 118 and a single horn segment 120 are shown, some implementations may include a plurality of high-frequency transducers coupled to the coupling member 116 via a plurality of horn segments. The panels 112, trays 114, coupling member 116 and horn segment 120 may be formed (e.g., machined) from metal and/or as molded plastic parts.

Figure 1C:
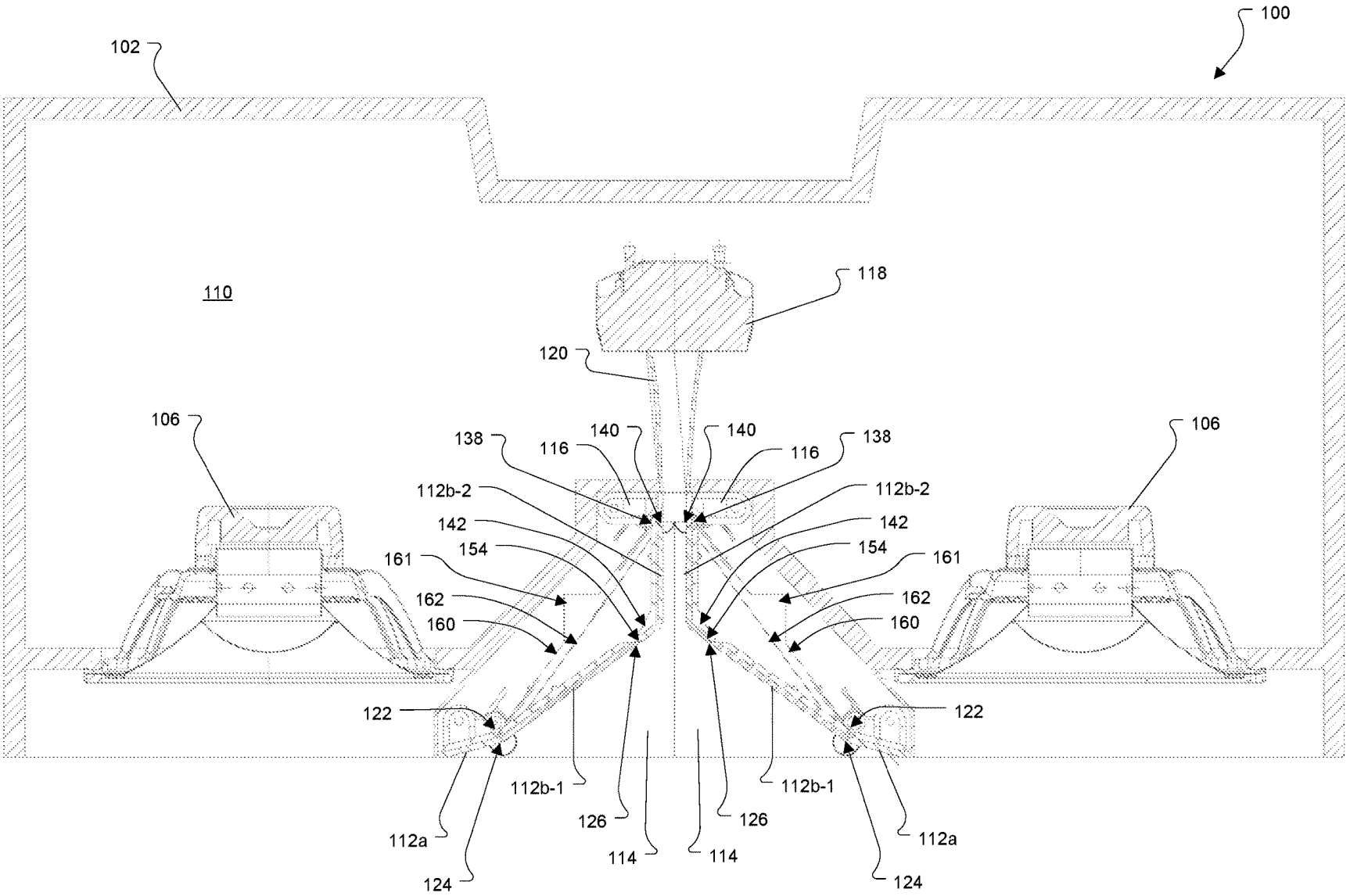
FIG. 1C is cross-sectional top view of the loudspeaker of FIG. 1A, taken along line 1C-1C in FIG. 1B, with a waveguide shown in a first orientation.
Figure 1D:
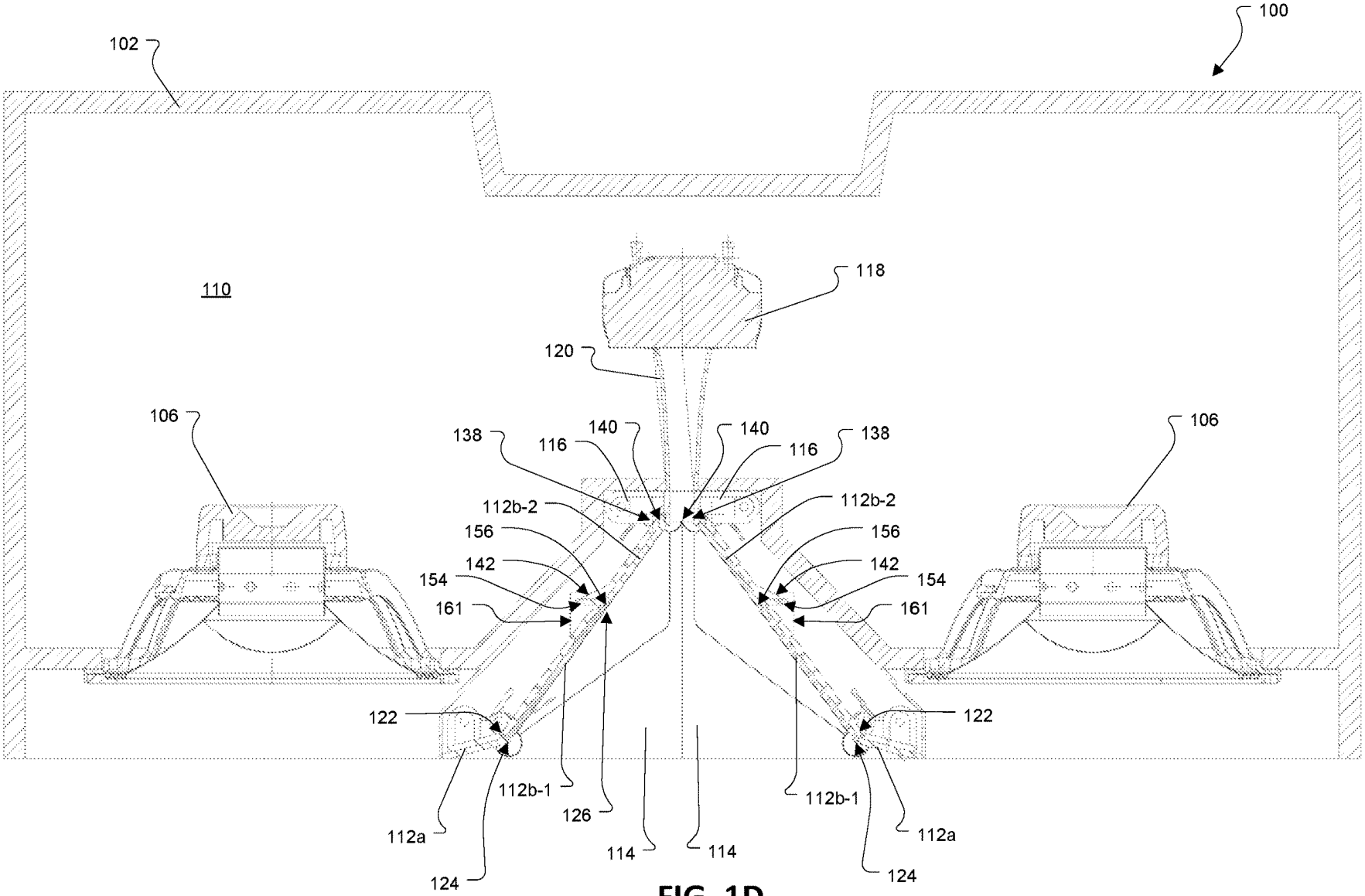
FIG. 1D is a cross-sectional top view of the loudspeaker of FIG. 1A with the waveguide shown in a second orientation.
Figure 2:
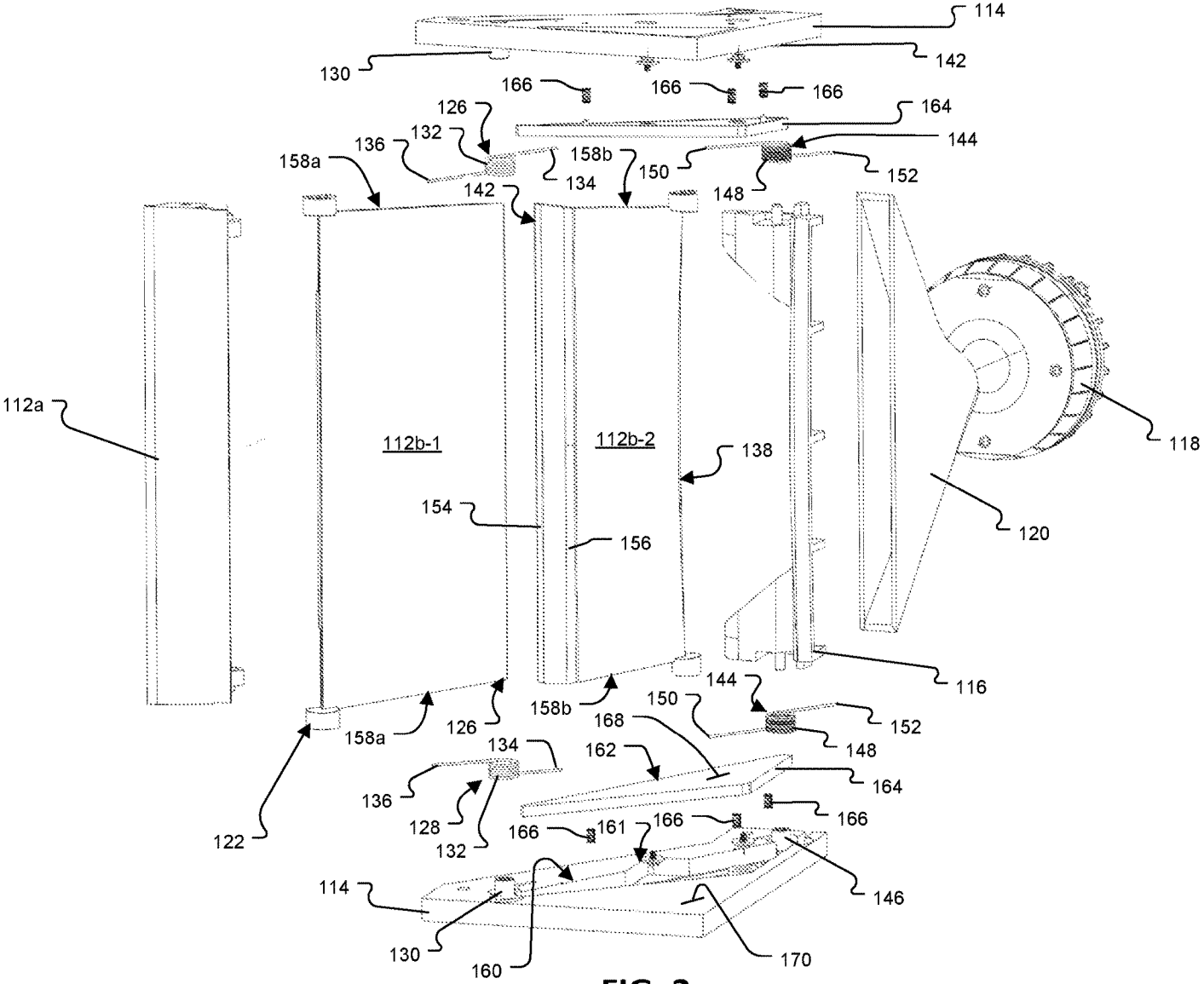
FIG. 2 is an exploded perspective view of a portion of a waveguide assembly from the loudspeaker of FIG. 1A.

With reference to FIGS. 1C, 1D, and 2, the plurality of panels 112 include a pair of fixed panels 112*a* and a plurality of displaceable panels 112*b*-1, 112*b*-2 (generally "112*b*"). The fixed panels 112*a* remain stationary relative to the trays 114, and the displaceable panels 112*b* are moveable relative to the trays 114, thereby enabling adjustment of the coverage pattern of the loudspeaker 100. The displaceable panels 112*b* at least partially define a primary flare of the waveguide and the fixed panels at least partially define a secondary flare of the waveguide. The primary flare having a first expansion rate and the second flare having a second expansion rate different from the first expansion rate.

The displaceable panels 112*b* include a pair of front panels 112*b*-1 (one shown in FIG. 2) and a pair or rear panels 112*b*-2 (one shown in FIG. 2). The front panels 112*b*-1 each have a first end 122 that is rotatably coupled to a pair of the trays 114 (i.e., a top and a bottom tray) at first (front) pivot points 124, and a second, free end 126 that is movable relative to the trays 114. In the illustrated example, a set of first (front) torsion springs 128 is provided at or near the first (front) pivot points 124. Each of the front torsion springs 128 is supported on an associated one of the trays 114 with a protrusion 130 defined by the tray 114 extending through a main body portion 132 of the associated first torsion spring 128. Each of the front torsion springs 128 has a first end 134 that is arranged to engage the associated one of the trays 114 and a second end 136 that is that is arranged to engage an associated one of the front panels 112*b*-1 so as to bias the second, free end 126 of the associated front panel 112*b*-1 towards the center of the waveguide. The front torsion springs 128 are retained in the trays 114 by the fixed panels 112*a*, i.e., the fixed panels 112*a* are coupled to the trays 114 such that the front torsion springs 128 are sandwiched therebetween.

The rear panels 112*b*-2 each have a first end 138 that is rotatably coupled to a pair of the trays 114 at second (rear) pivot points 140, and a second, free end 142 that is movable relative to the trays 114. A set of second (rear) torsion springs 144 is provided at or near the rear pivot points 140.

Each of the rear torsion springs 144 is supported on an associated one of the trays 114 with a protrusion 146 defined by the tray 114 extending through a main body portion 148 of the associated rear torsion spring 144. Each of the rear torsion springs 144 has a first end 150 that is arranged to engage the associated one of the trays 114 and a second end 152 that is that is arranged to engage an associated one of the rear panels 112*b*-2 so as to bias the second, free end 142 of the associated rear panel 112*b*-2 towards the center of the waveguide. The rear torsion springs 144 are retained in the trays 114 by the coupling member 116; i.e., the coupling member 116 is coupled to the trays 114 such that the rear torsion springs 144 are sandwiched therebetween.

The displaceable panels 112*b* are moveable (pivotable) between a first orientation (FIG. 1C) providing a first coverage pattern and a second orientation (FIG. 1D) providing a second coverage pattern that is narrower than the first coverage pattern. In some cases, the first orientation provides a 120° horizontal coverage pattern and the second orientation provides an 80° horizontal coverage pattern. In the first orientation, the free ends 126 of the front panels 112*b*-1 each abut a first surface 154 at the free end 142 of an associated one of the rear panels 112*b*-2. And, in the second orientation, the fee ends 126 of the front panels 112*b*-1 each abut a second surface 156 at the free end 142 of the associated one of the rear panels 112*b*-2.

Side edges 158*a*, 158*b* of the displaceable panels 112*b* are accommodated in recesses 160 defined by the trays 114, shown with one recess 160 in each of the trays 114. The depth of the recesses 160 in the trays 114 is a function of two things. 1.) The total depth of the waveguide assembly (front to back of speaker). Here, a deeper waveguide would cause a greater differential in the vertical height between the two pivot locations due to the fixed vertical angle of the cabinet enclosure (10 degrees). To close the gaps created by this differential we must increase the tray depth. 2.) The range of rotation between the WIDE and NARROW coverage patterns. If the difference in angles is small, there will be only a small gap to account for with the tray. As the difference in angles grows, panels must rotate further, and the gaps will increase. In some cases, the recesses 160 are between about 10 mm and about 18 mm deep. The recesses 160 each include a notch 161 which accommodates a portion of the second end 142 of the rear panel 112*b*-2 that includes the first surface 154; i.e., when the displaceable panels 112*b* are in the second orientation. Also accommodated in each of the recesses 160 is a retaining mechanism 162. In the illustrated example, the retaining mechanism 162 includes a button 164 that is supported by a plurality of compression springs 166 (FIG. 2). In the first (wide) orientation, the displaceable panels 112*b* overlap the buttons 164 and retain the buttons 164 in a compressed position within the associated recesses 160. To provide the second coverage pattern, the displaceable panels 112*b* can then be pivoted (e.g., manually) to a position in which they do not overlap the buttons 164, thereby allowing the buttons 164 to be biased outward under the force of the compression springs 166. In their extended position, respective top surfaces 168 (FIG. 2) of the buttons 166 are substantially flush with an inner surface 170 (FIG. 2) of the associated one of the trays 114. In this second (narrow) orientation, sidewalls of the buttons 164 abut respective side edges 158*a*, 158*b* of the displaceable panels 112*b* to retain the displaceable panels 112*b* in the second orientation, resisting the biasing forces of the front and rear torsion springs 128, 144.

To return the displaceable panels 112*b* to the first (wide) orientation, the buttons 164 can be depressed into the respective recesses 160 so that that the side edges 158*a*, 158*b* of the displaceable panels 112*b* are clear of the sidewalls of the buttons 164 and the displaceable panels 112*b* will be biased back to the first orientation via a force provided by the front and rear torsions springs 128, 144.

The illustrated configuration show four trays 114, including two (left and right) top trays and two (left and right) bottom trays; however, configurations with two trays 114, e.g., one top tray and one bottom tray are also contemplated. That is, the features of the two top trays illustrated in the figures may be combined in one unitary structure and likewise for the two bottom trays. In some implementations all or part of the trays may be formed integrally with the enclosure.

Other Implementations

While an implementation has been described in which the displacement of the displaceable panels is controlled manually, e.g., via a manual force applied to the panels themselves or via a force applied to the buttons, in other implementations, the movement of the displaceable panels may be automated, e.g., via motors incorporated in the panels or in the trays.

With reference to FIGS. 3A through 3D, in another implementation, a loudspeaker 300 includes an enclosure 302 that supports a waveguide assembly 304, a pair of low-frequency transducers 306, and a plurality of bass reflex ports 308. The enclosure 302 includes plurality of walls that together at least partially define an acoustic cavity 310. The low-frequency transducers 306 are mounted to a front wall of the enclosure 302 and are arranged such that respective first radiating surfaces of the low-frequency transducers 306 radiate acoustic energy outwardly from the front wall and respective second radiating surfaces of the low-frequency transducers 306 radiate acoustic energy into the acoustic cavity 310 which is acoustically coupled to the bass reflex ports 308.

Figure 3A:
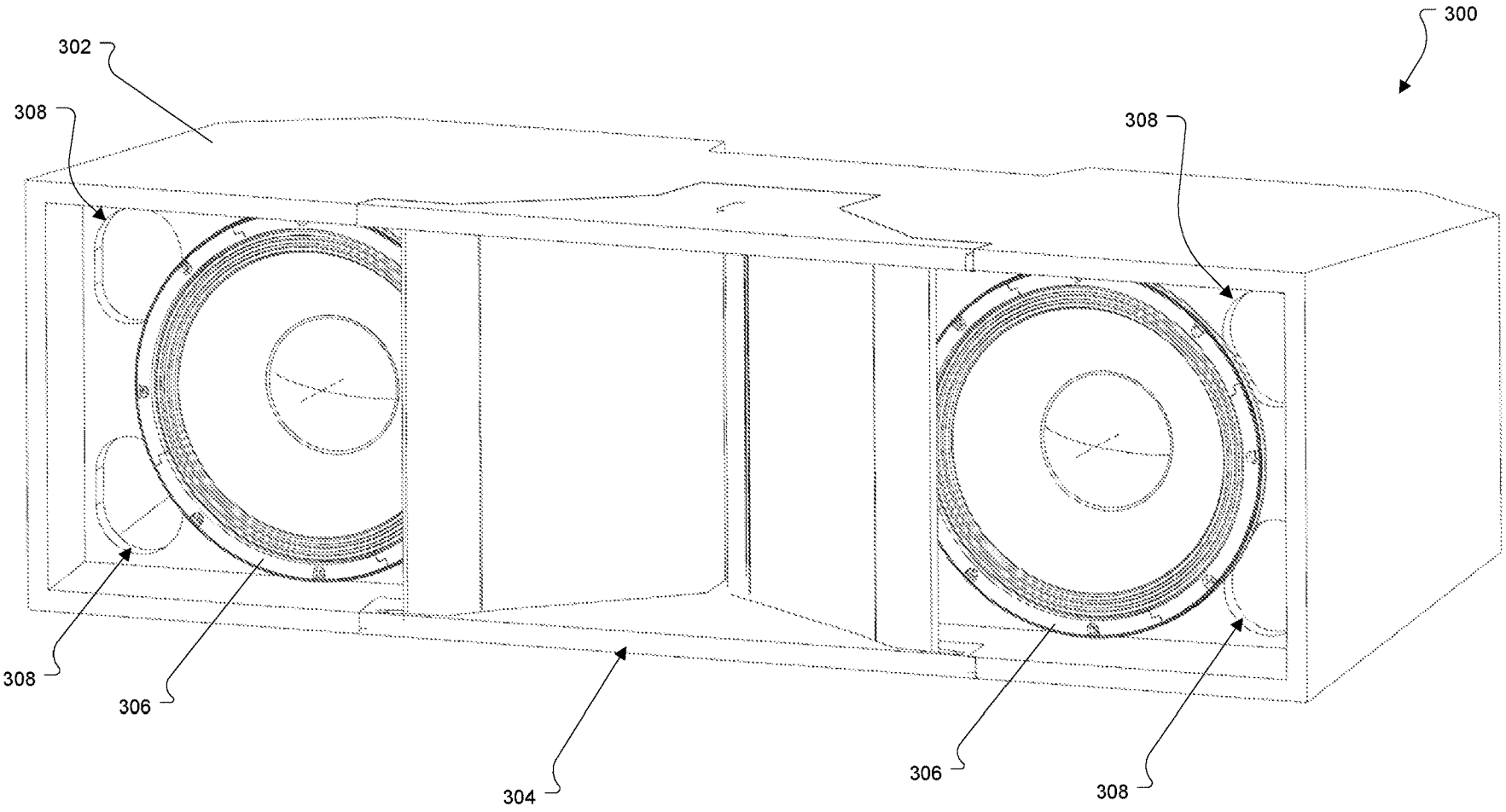
FIG. 3A is a perspective view of a loudspeaker shown from the front, top, and right side.
Figure 3B:
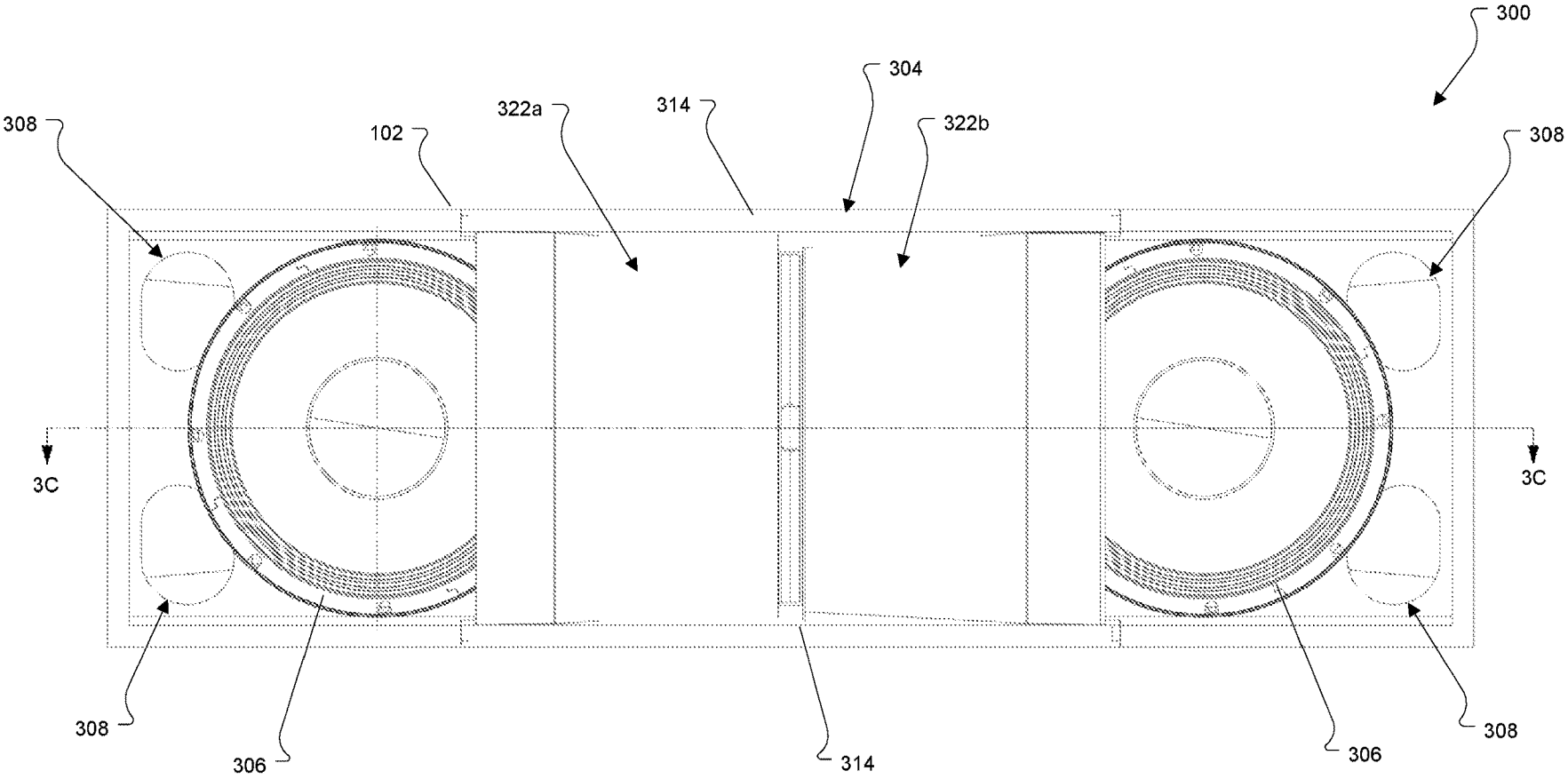
FIG. 3B is a front view of the loudspeaker of FIG. 3A.
Figure 3C:
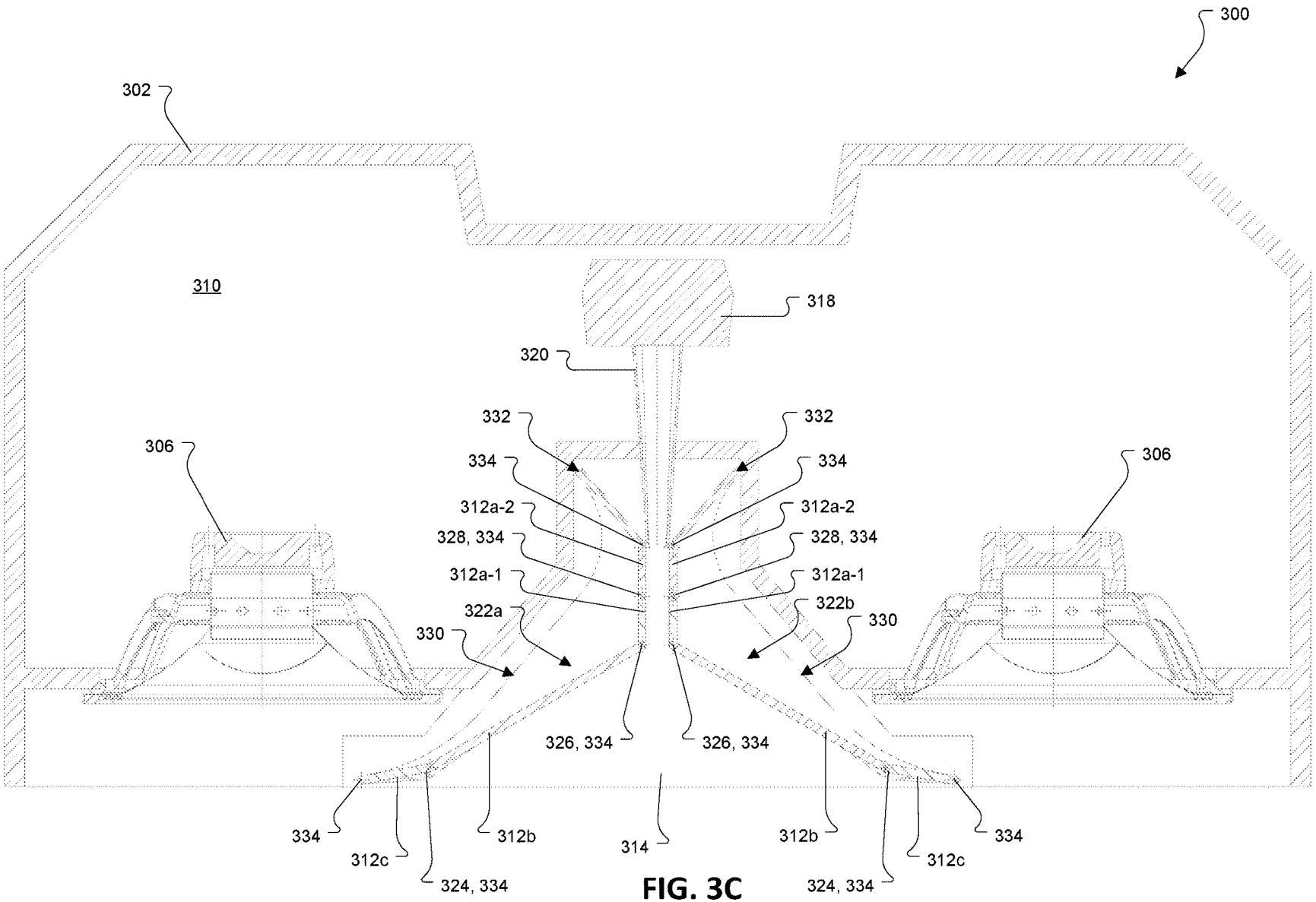
FIG. 3C is cross-sectional top view of the loudspeaker of FIG. 3A, taken along line 3C-3C in FIG. 3B, with a waveguide shown in a first orientation.
Figure 3D:
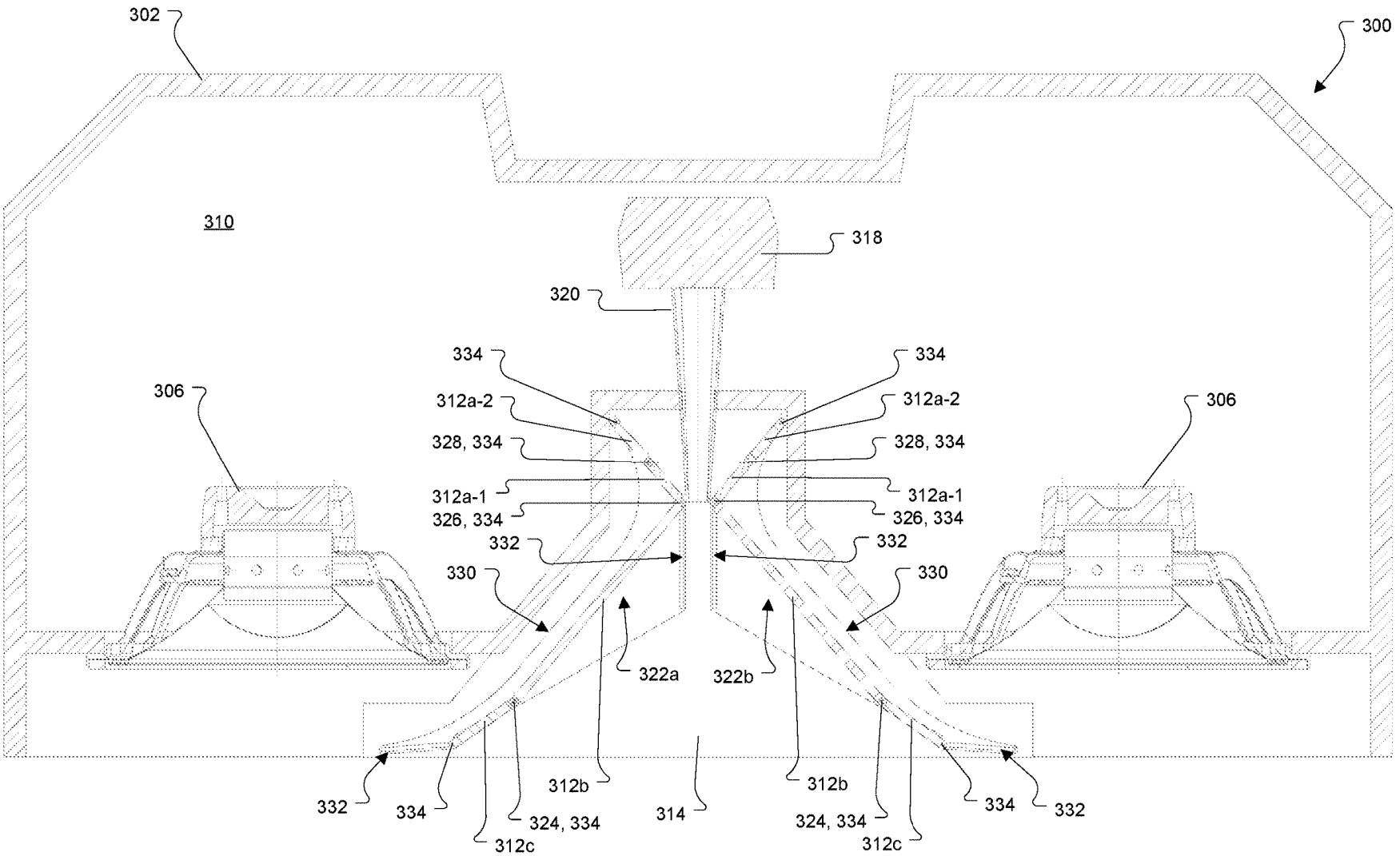
FIG. 3D is a cross-sectional top view of the loudspeaker of FIG. 3A with the waveguide shown in a second orientation.
Figure 4:
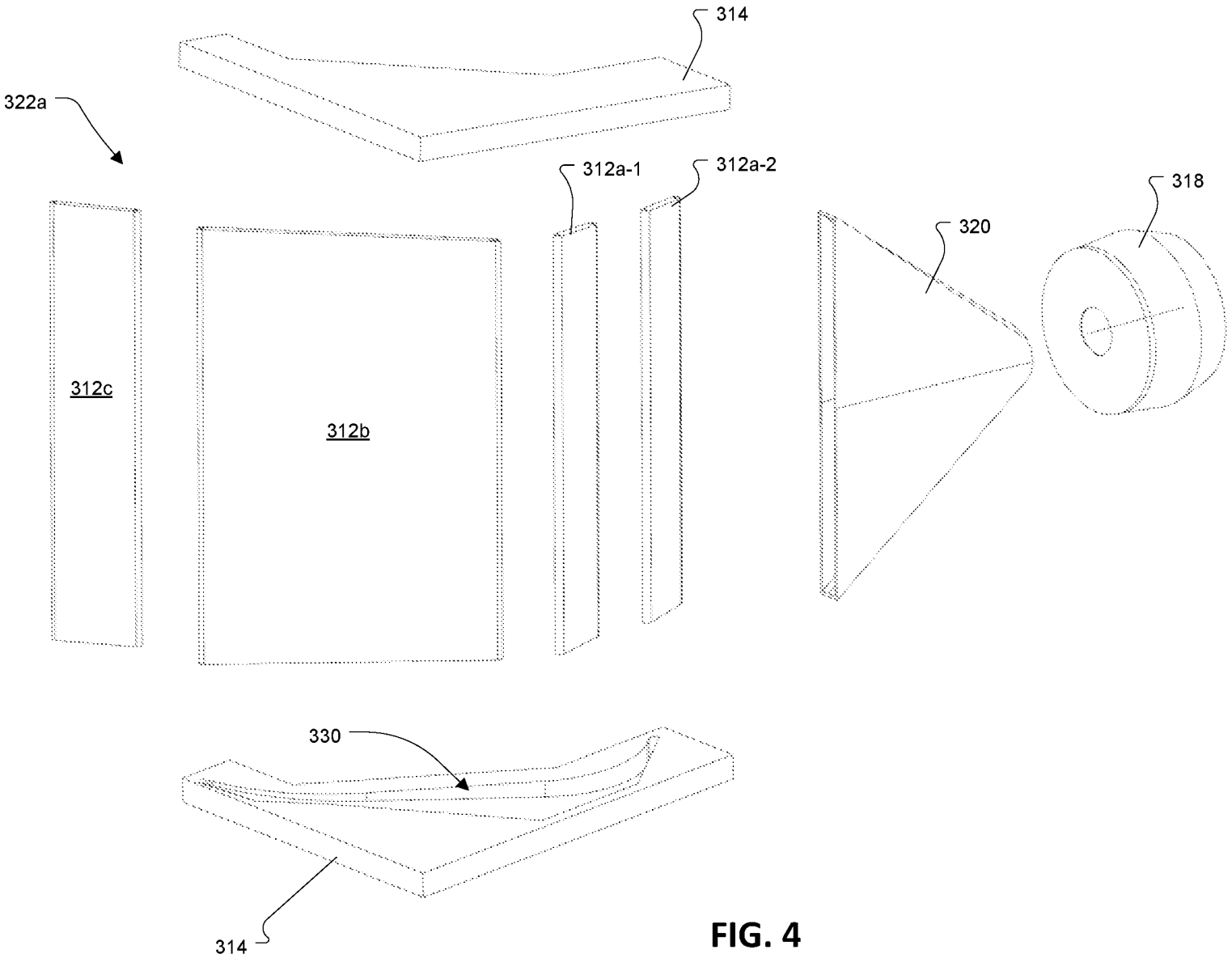
FIG. 4 is an exploded perspective view of a portion of a waveguide assembly from the loudspeaker of FIG. 3A.

Referring to FIGS. 3C, 3D, and 4, the waveguide assembly 304 includes a plurality of panels 312*a*-1, 312*a*-2, 312*b*, 312*c* (collectively "312") and a plurality of trays 314. Together the panels 312 and the trays 314 at least partially define a waveguide. The waveguide assembly 304 also includes a coupling member (not shown) which supports a high-frequency transducer 318 within the acoustic cavity 310. The high-frequency transducer 318 is coupled, both mechanically and acoustically, to the coupling member by a horn segment 320. While a single high-frequency transducer 318 and a single horn segment 320 are shown, some implementations may include a plurality of high-frequency transducers coupled to the coupling member via a plurality of horn segments.

The plurality of panels includes a first plurality of panels 322*a* that form a first sidewall of the waveguide, and a second plurality of panels 322*b* that form a second sidewall of the waveguide. Each of the first and second plurality of panels 322*a*, 322*b* includes one or more rear panels 312*a*-1, 312*a*-2 (generally "312*a*"), a main panel 312*b*, and a front panel 312*c*. The main panels 312*b* at least partially define a primary flare of the waveguide, and the front panels 312*c* at least partially define a secondary flare of the waveguide. In each of the first and second plurality of panels 322*a*, 322*b*, the front panel 312*c* is coupled to the main panel 312*b* at a first hinge 324 and the main panel 324 is coupled to a first rear panel 312*a*-1 at a second hinge 326, and, in the illustrated example, the first rear panel 312*a*-1 is connected to a second rear panel 312*a*-2 at a third hinge 328.

Figure 3E:
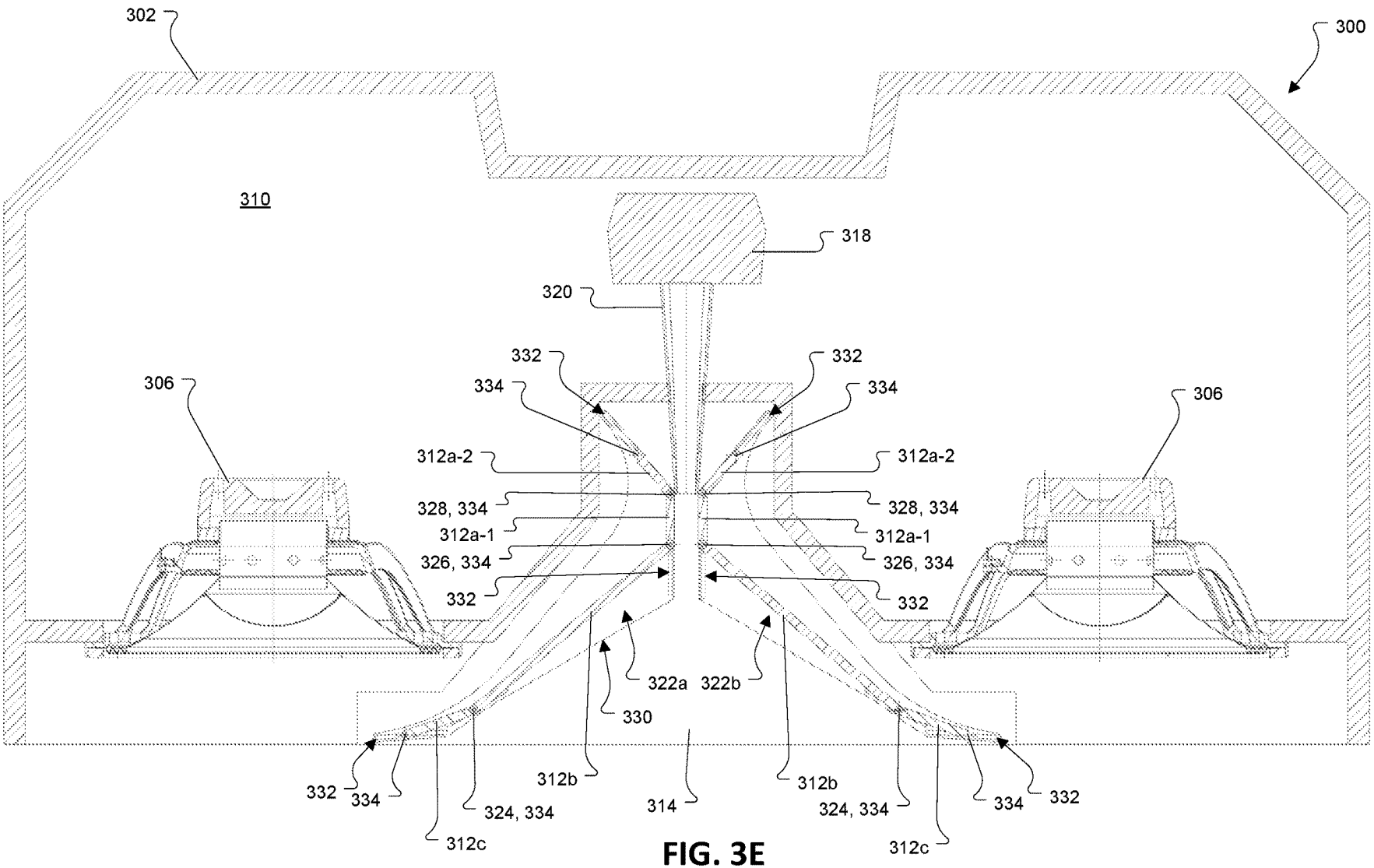
FIG. 3E is a cross-sectional top view of the loudspeaker of FIG. 3A with the waveguide shown in a third orientation.
Figure 5:
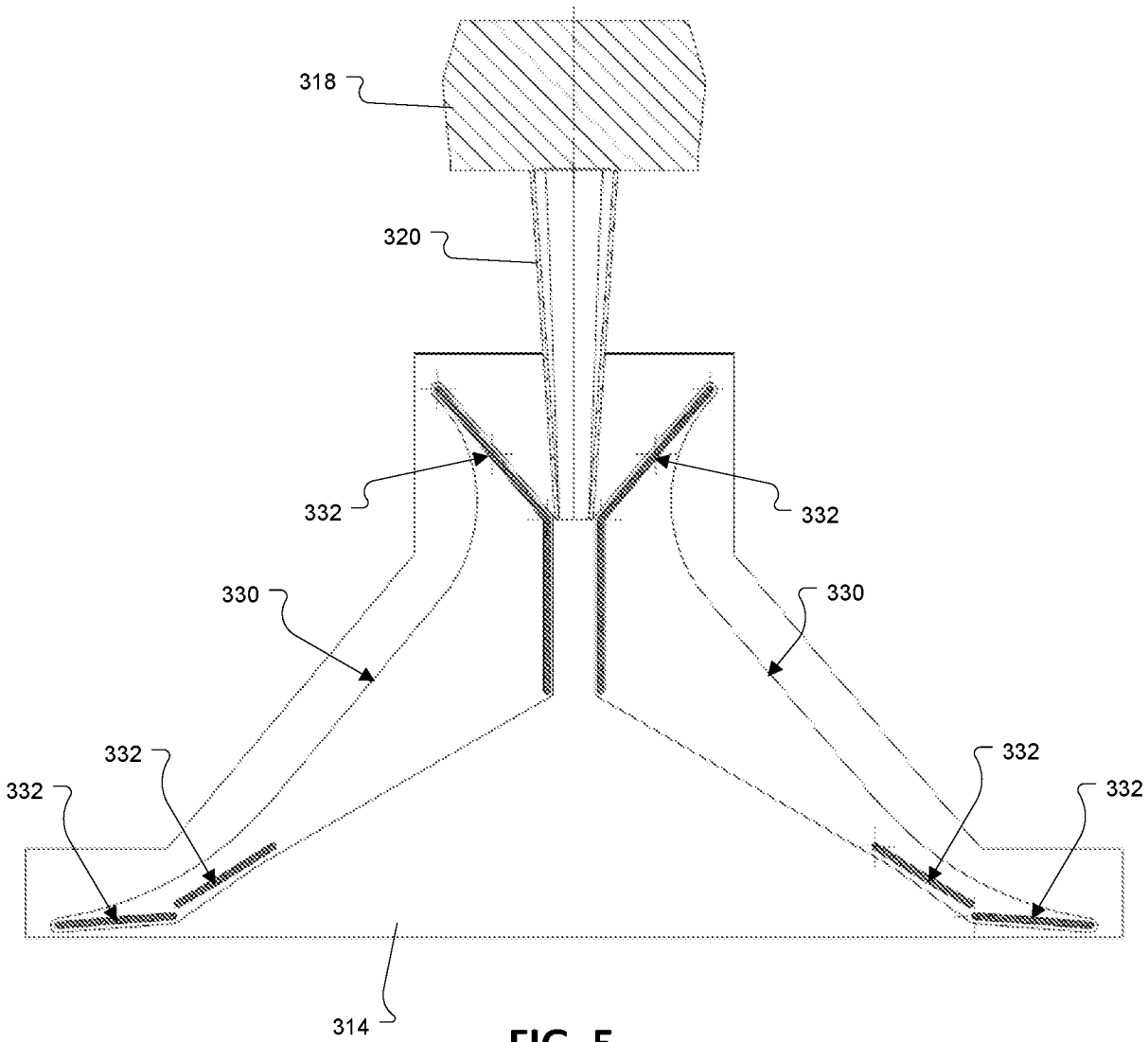
FIG. 5 is top view of a portion of a waveguide assembly from the loudspeaker of FIG. 3A highlighting slots.
Figure 6A:
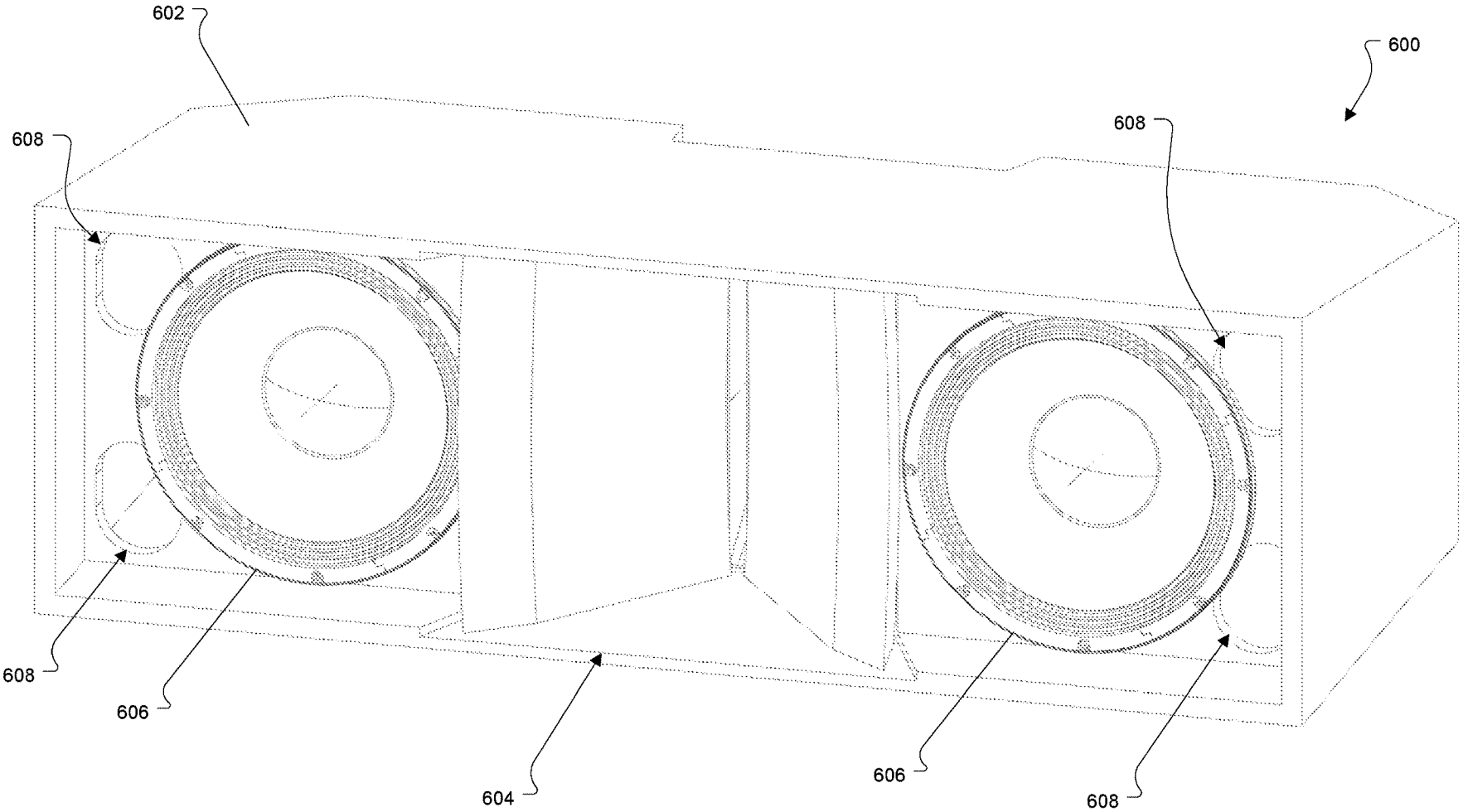
FIG. 6A is a perspective view of a loudspeaker shown from the front, top, and right side.
Figure 6B:
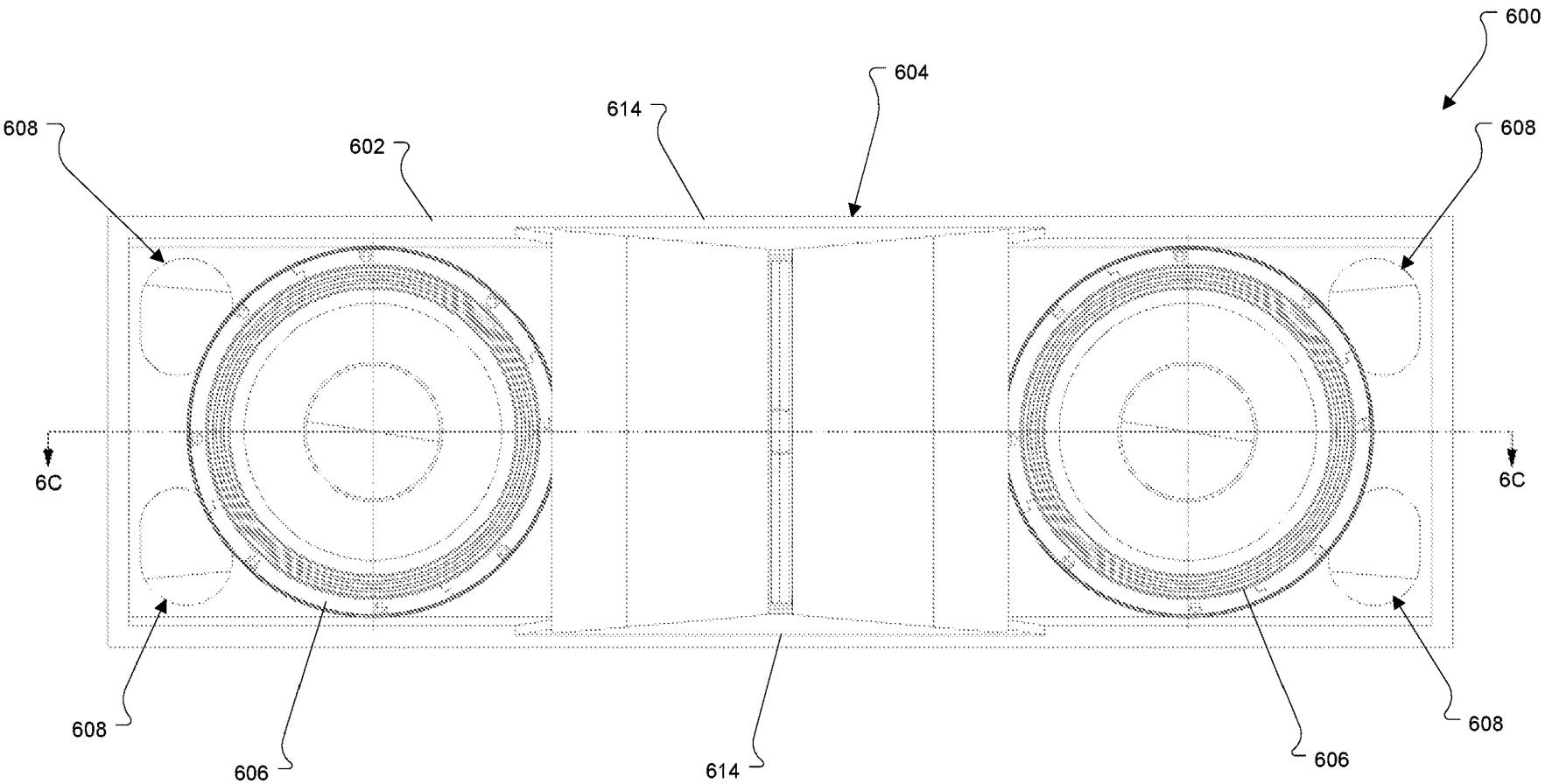
FIG. 6B is a front view of the loudspeaker of FIG. 6A.
Figure 6C:
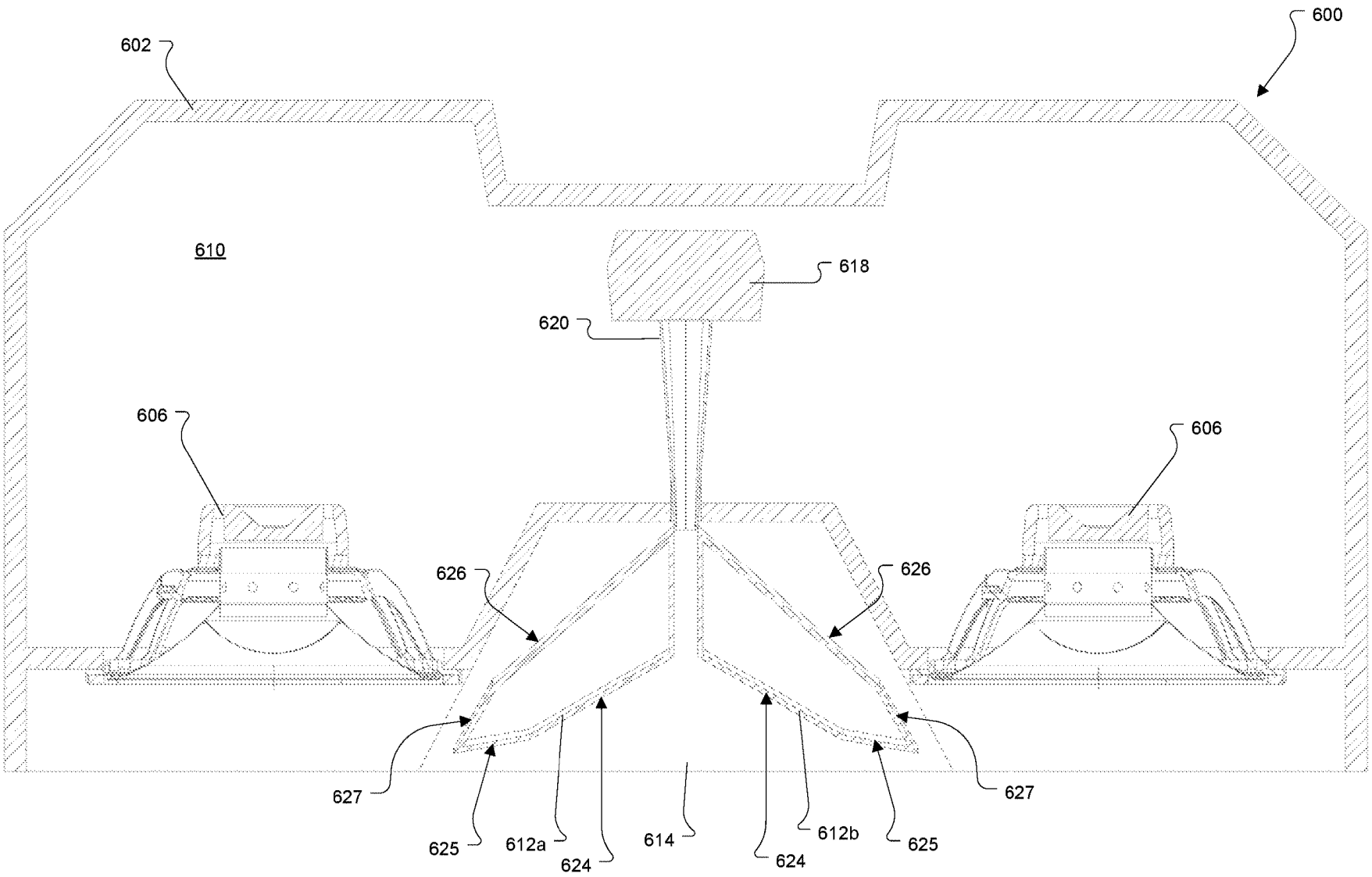
FIG. 6C is cross-sectional top view of the loudspeaker of FIG. 6A, taken along line 6C-6C in FIG. 6B, with a waveguide shown in a first orientation.
Figure 6D:
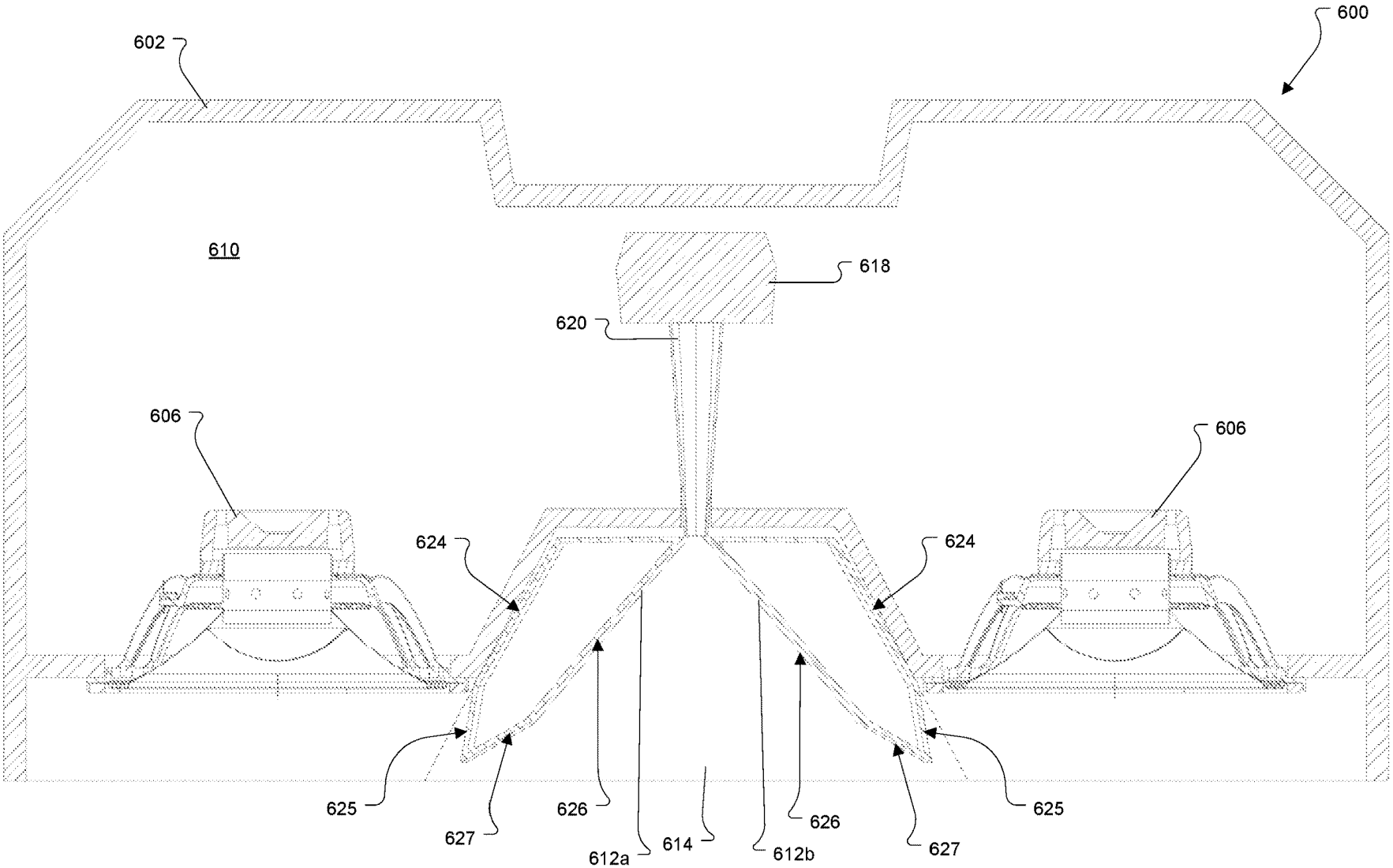
FIG. 6D is a cross-sectional top view of the loudspeaker of FIG. 6A with the waveguide shown in a second orientation.
Figure 7A:
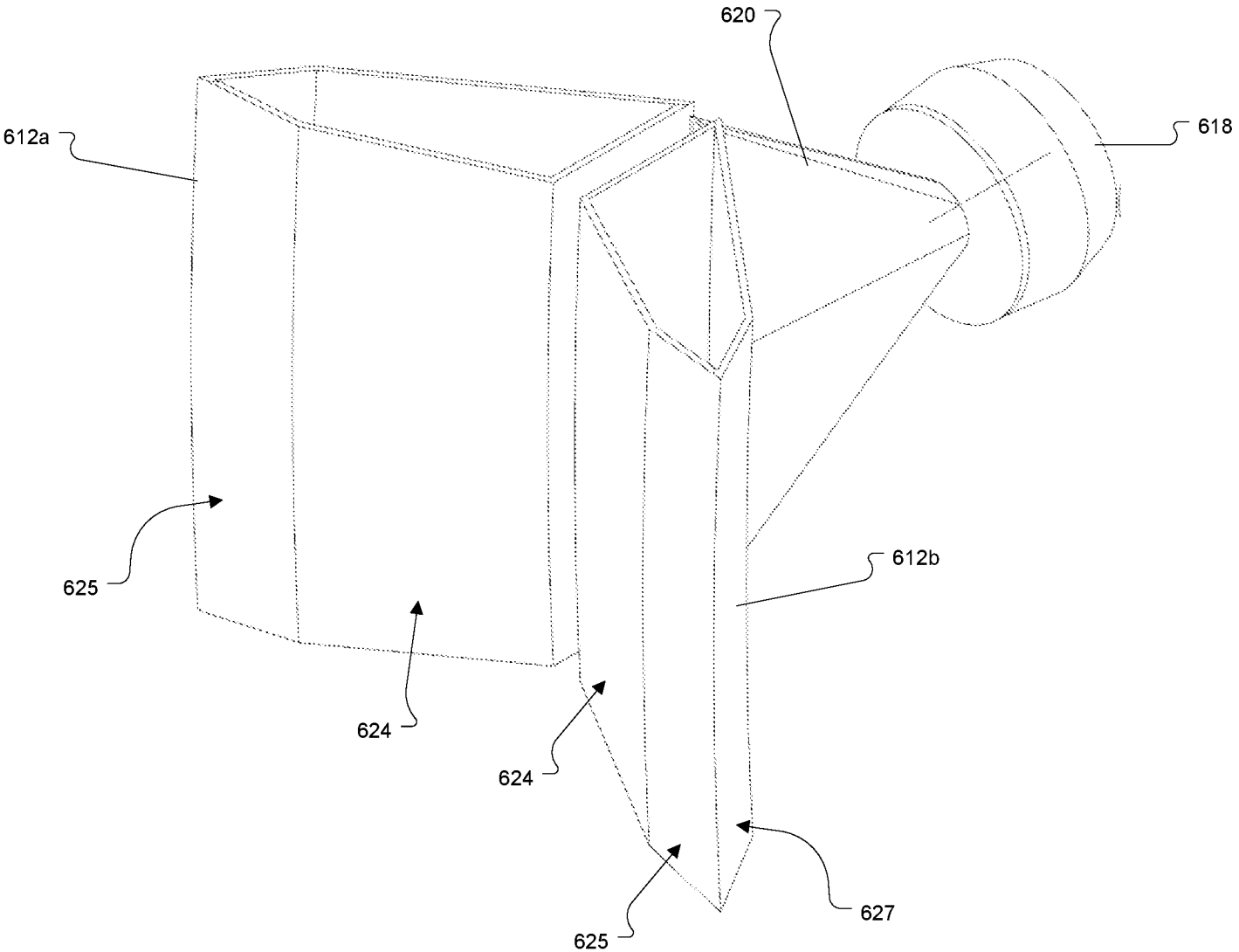
FIG. 7A is a perspective view of a portion of a waveguide assembly from the loudspeaker of FIG. 6A, with a waveguide shown in a first orientation.
Figure 7B:
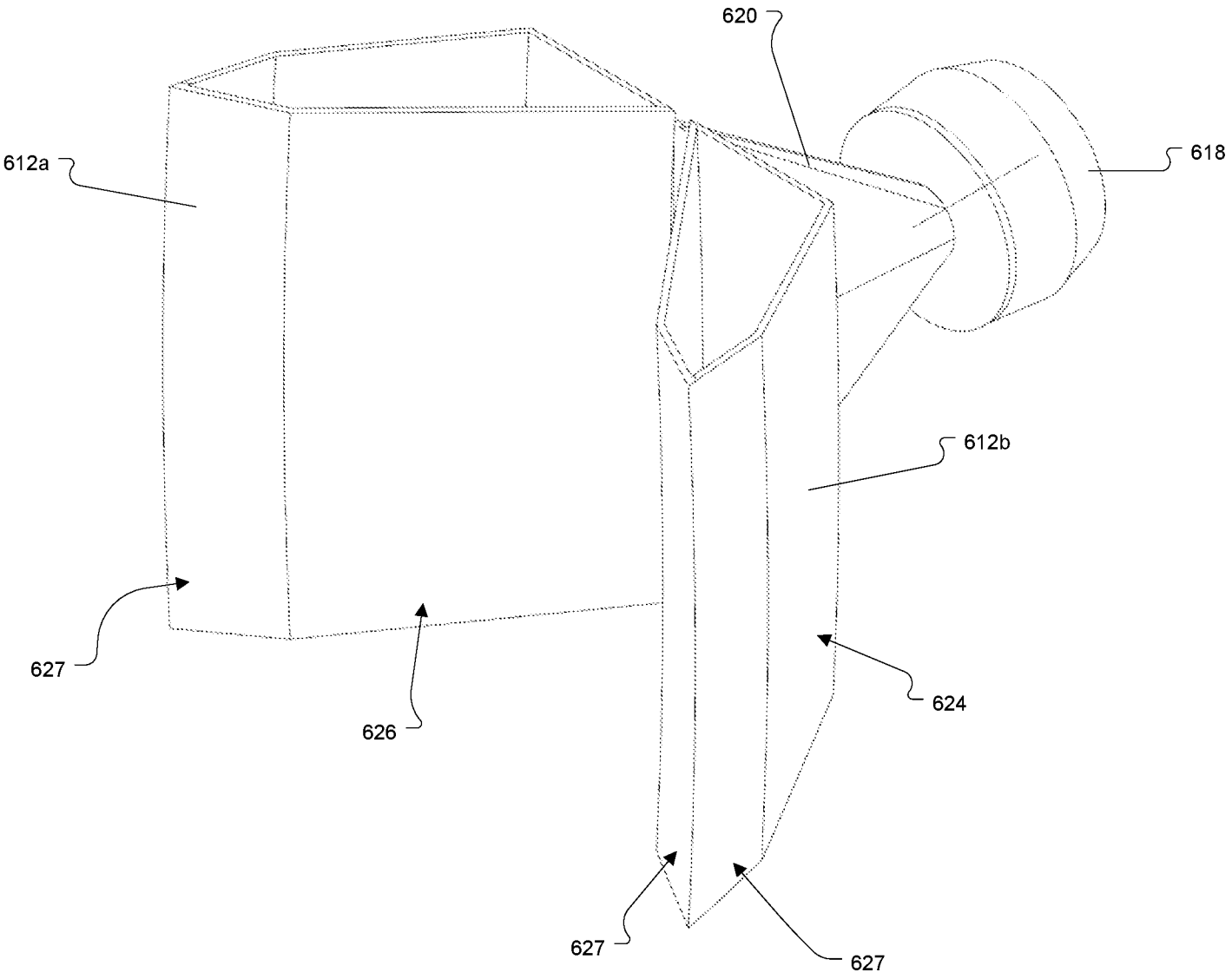
FIG. 7B is a perspective view of a portion of a waveguide assembly from the loudspeaker of FIG. 6A, with the waveguide shown in a second orientation.

Side edges of the panels 312 are slidably received in tracks 330 defined by the trays 314. The tracks 330 may include slots 332 (FIG. 5) which help to guide the movement of the panels 314. In that regard, pins 334 coupled to the panels 312 (e.g., at the hinges 324, 326, 328, and at the unhinged ends of the front panel 312*c* and the second rear panel 312*a*-2) may ride in the slots 332. The panels 312 are moveable between a first orientation (FIG. 3C) providing a first coverage pattern and a second orientation (FIG. 3D) providing a second coverage pattern that is narrower than the first coverage pattern by sliding the panels fore and aft relative to the trays 314. In some cases, the first orientation provides a 120° horizontal coverage pattern and the second orientation provides an 80° horizontal coverage pattern. In some implementations, the first and second pluralities of panels 322*a*, 322*b* may be positioned in a third orientation (FIG. 3E) that provides a third coverage pattern that is narrower than the first coverage pattern and wider than the second coverage pattern by sliding the panels fore and aft relative to the trays. Displacement of the panels may be controlled manually, or via a motor and associated control electronics. For example, in some implementations, the motion of the panels could be driven by linear actuators, which, in some cases, may be controlled remotely.

FIGS. 6A through 6D illustrate yet another configuration of a loudspeaker 600 with an adjustable waveguide. The loudspeaker 600 includes an enclosure 602 that supports a waveguide assembly 604, a pair of low-frequency transducers 606, and a plurality of bass reflex ports 608. The enclosure 602 includes plurality of walls that together at least partially define an acoustic cavity 610. The low-frequency transducers 606 are mounted to a front wall of the enclosure 602 and are arranged such that respective first radiating surfaces of the low-frequency transducers 606 radiate acoustic energy outwardly from the front wall and respective second radiating surfaces of the low-frequency transducers 606 radiate acoustic energy into the acoustic cavity 610 which is acoustically coupled to the bass reflex ports 608.

With reference to FIGS. 6C, 6D, 7A, and 7B, the waveguide assembly 604 includes a plurality of panels 612*a*, 612*b* (generally "612") and a plurality of trays 614. Together the panels 612 and the tray 614 at least partially define a waveguide. In the example illustrated in FIGS. 6A-6D, the trays 614 are in the form of recessed regions formed integrally with the enclosure 602. The waveguide assembly 604 also includes a coupling member (not shown) which supports a high-frequency transducer 618 within the acoustic cavity 610. The high-frequency transducer 618 is coupled, both mechanically and acoustically, to the coupling member by a horn segment 620. While a single high-frequency transducer 618 and a single horn segment 620 are shown, some implementations may include a plurality of high-frequency transducers coupled to the coupling member via a plurality of horn segments.

The plurality of panels 612 includes a left panel 612*a* and a right panel 612*b*. Each of the panels 612 includes a first surface 624 that defines a first coverage angle and a second surface 626 that defines a second coverage angle. Each of the panels 612 also includes a third surface 625 and a fourth surface 627. In the first orientation, the first surface 624 at least partially defines a primary flare of the waveguide and the third surface 625 at least partially defines a secondary flare of the waveguide. And, in the second orientation, the second surface 626 at least partially defines a primary flare of the waveguide and the fourth surface 627 at least partially defines a secondary flare of the waveguide. The primary flare having a first expansion rate and the second flare having a second expansion rate different from the first expansion rate in both orientations.

The panels 612 are slidably received between the trays 614 and can be removed, reoriented, and reinserted to adjust the coverage pattern of the waveguide. The panels 612 can be arranged in a first orientation (FIGS. 6C & 7A) in which the respective first surfaces 614 of the left and right panels 612*a*, 612*b* face each other to provide a first coverage pattern and a second orientation (FIGS. 6D & 7B) in which the respective second surfaces 616 of the left and right panels 612*a*, 612*b* face each other to provide a second coverage pattern that is narrower than the first coverage pattern. In some cases, the first orientation provides a 120° horizontal coverage pattern and the second orientation provides an 80° horizontal coverage pattern.

In some cases, the left and right panels 612*a*, 612*b* may be coupled together, e.g., via a living hinge, such that they can be removed together as a single piece that still allows the left panel 612*a* and the right panel 612*b* to be moved relative to each other so that both coverage patterns may be achieved. Alternatively, each panel 612 could be tethered to the enclosure 602 such that they do not fall out of the enclosure 602 or get lost.

Figure 8:
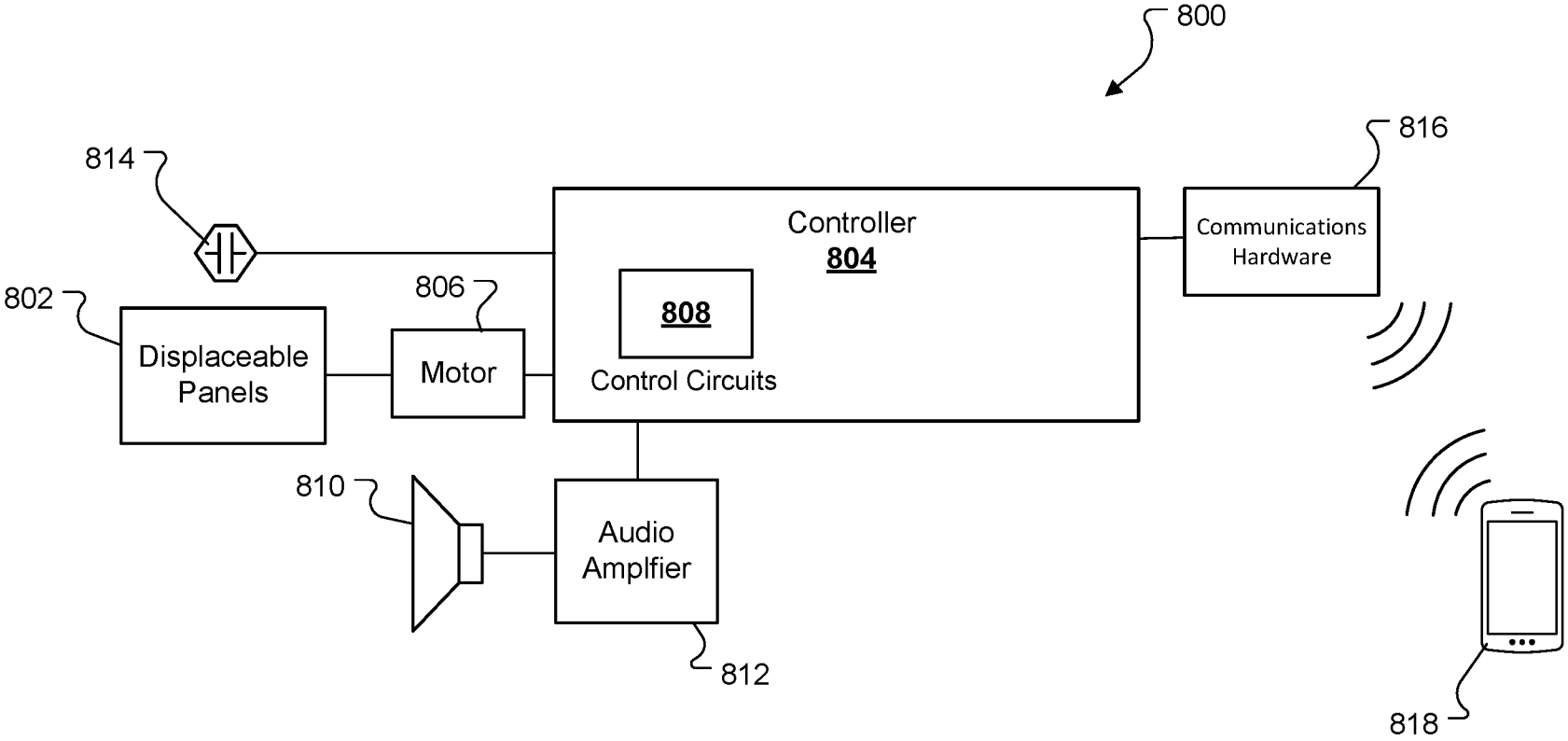
FIG. 8 is a schematic of the components of a loudspeaker in one example of the present disclosure.

FIG. 8 provides an exemplary schematic of a loudspeaker 800, showing its components. As shown, the loudspeaker 800 includes displaceable (moveable) panels 802 (such as in the implementations described above) that can be controlled using a controller 804 and, in some cases, can be repositioned using a motor 806 (e.g., an electro-magnetic motor). The motor 806 may be a rotary motor or a linear actuator. In various implementations, the motor 806 is coupled with one or more control circuits 808 (e.g., in the controller 804) for providing electrical signals to adjust the position of the panels 802. The control circuit(s), where applicable, can include a processor and/or a microcontroller, which in turn can include electro-mechanical control hardware/software, and decoders, DSP hardware/software, etc. for playing back (rendering) audio content at one or more electro-acoustic transducers 810. The control circuit(s) can also include one or more digital-to-analog (D/A) converters for converting a digital audio signal to an analog audio signal. This audio hardware can also include one or more amplifiers 812 which provide amplified analog audio signals to the one or more electro-acoustic transducers 810.

The loudspeaker 600 may also include one or more sensors 814, e.g., located on the displaceable panels 802 and/or elsewhere on the loudspeaker. In various implementations, the sensor(s) 814 are configured to detect the relative position of the displaceable panels 802. The sensor(s) 814 are connected with the controller 804 in various implementations. In particular cases, the sensor(s) 814 include a reed switch and a magnet. For example, the reed switch can be located (e.g., mounted or otherwise affixed) on a tray or enclosure of the loudspeaker 800 one of the panels 802, while the magnet can be located on one of the displaceable panels 802, or vice-versa. In other implementations, the sensor(s) may include a Hall effect sensor and a magnet. The Hall effect sensor can be mounted on a tray or an enclosure of the loudspeaker 800 and the magnet can be mounted on one of the displaceable panels 802, or vice-versa. In still further implementations, the sensor(s) 814 may include an optical sensor mounted to detect the position of the displaceable walls.

In certain implementations, the sensor(s) 814 provide feedback to the controller 804 about a position of the displaceable panels 802. In particular cases, the controller

804 is configured to adjust an acoustic parameter of the loudspeaker 800 in response to a detected change in the relative position of the displaceable panels 802 relative to the loudspeaker's enclosure. That is, the controller 804 is configured to adjust one or more acoustic parameters of the loudspeaker 800 based upon the detected position of the displaceable panels 802. In some examples, in response to detecting that the panels 802 have changed position with respect to the enclosure, the controller 804 is configured to adjust an equalization setting of the loudspeaker 800 (e.g., amplitude, phase, and/or delay).

In particular implementations, the loudspeaker 800 is one of an array of loudspeakers. In these cases, the controller 804 is configured to communicate with controllers in other loudspeakers in the array and/or a central controller for adjusting the positions of the panels 802; i.e., to adjust the coverage pattern. In various implementations, the controllers in loudspeakers within an array are configured to communicate with one another and/or a central controller to assign coverage patterns for each of the loudspeakers.

In additional implementations, the control circuit(s) include sensor data processing logic for processing data from the sensors 814, e.g., to control adjustment of the displaceable panels 802. In certain additional cases, the controller 804 can be configured to display or otherwise indicate the current coverage pattern, e.g., at a user interface.

In some implementations, the loudspeaker 800 may include communications hardware 816. The communications hardware 816 may include any wired or wireless communications means suitable for use with the loudspeaker 800, such as WiFi, Bluetooth, LTE, USB, micro USB, or any suitable wired or wireless communications technologies known to one of ordinary skill in the art. Information regarding the current position of the displaceable panels may be delivered to a user device, such as a smart phone 818, for display via a UI presented on the user device. The communications hardware 816 may also receive, e.g., from the user device, control instructions for adjusting the position of the displaceable panels 802 thereby allowing a user to set the coverage pattern remotely. The communications hardware 816 may also be used to communicate with other loudspeakers, e.g., other loudspeakers in an array, as discussed above.

In operation, the control circuit(s) in the loudspeaker 800 are configured to convert an electrical signal to an acoustic output at the transducer(s) 810. The displaceable panels 802 allow for adjustment to the radiation pattern of the loudspeaker 800 according to desired use cases. In contrast to conventional loudspeakers, the loudspeaker 800 provides an adaptable, reliable and cost-effective speaker configuration that can be particularly useful in traveling (or touring) and/or rental cases. In particular examples, the loudspeaker 800 can be used to adapt a physical space for different purposes, e.g., for different events at the same venue, where seating arrangement are adjusted and/or stage location is modified.

One or more components in the loudspeaker 800 can be formed of any conventional loudspeaker material, e.g., a heavy plastic, metal (e.g., aluminum, or alloys such as alloys of aluminum), composite material, etc. It is understood that the relative proportions, sizes and shapes of the loudspeaker and components and features thereof as shown in the FIGURES included herein can be merely illustrative of such physical attributes of these components. That is, these proportions, shapes and sizes can be modified according to various implementations to fit a variety of products. For example, while a substantially circular-shaped loudspeaker may be shown according to particular implementations, it is understood that the loudspeaker could also take on other three-dimensional shapes in order to provide acoustic functions described herein.

In various implementations, components described as being "coupled" to one another can be joined along one or more interfaces. In some implementations, these interfaces can include junctions between distinct components, and in other cases, these interfaces can include a solidly and/or integrally formed interconnection. That is, in some cases, components that are "coupled" to one another can be simultaneously formed to define a single continuous member. However, in other implementations, these coupled components can be formed as separate members and be subsequently joined through known processes (e.g., soldering, fastening, ultrasonic welding, bonding). In various implementations, electronic components described as being "coupled" can be linked via conventional hard-wired and/or wireless means such that these electronic components can communicate data with one another. Additionally, sub-components within a given component can be considered to be linked via conventional pathways, which may not necessarily be illustrated.

A number of implementations have been described. Nevertheless, it will be understood that additional modifications may be made without departing from the scope of the inventive concepts described herein, and, accordingly, other implementations are within the scope of the following claims.

What is claimed is:

1. A waveguide assembly for a loudspeaker, the waveguide assembly comprising:

a plurality of panels; and a plurality of trays, which together with the plurality of panels at least partially defines a waveguide, wherein one or more of the panels are arranged to be movable relative to the trays to adjust a coverage pattern of the waveguide, wherein the plurality of panels includes a pair of fixed panels that remain stationary relative to the trays and a plurality of displaceable panels that are movable relative to the trays to allow adjustment of the coverage pattern, wherein the displaceable panels comprise a pair of front panels and a pair of rear panels, wherein each of the front panels has a first end that is rotatably coupled to a pair (two) of the trays, and a second, free end that is moveable relative to the trays, wherein each of the rear panels has a first end that is rotatably coupled to a pair (two) of the trays, and a second, free end that is moveable relative to the trays, and wherein the displaceable panels are moveable (pivotable) between a first orientation providing a first coverage pattern and a second orientation providing a second coverage pattern that is narrower than the first coverage pattern.

2. The waveguide assembly of claim 1, further comprising a coupling member for acoustically coupling one or more electro-acoustic transducers to the waveguide.

3. The waveguide assembly of claim 1, wherein the displaceable panels at least partially define a primary flare (having a first expansion rate) of the waveguide, and wherein the fixed panels at least partially define a secondary flare (having a second expansion rate, different from the first expansion rate) of the waveguide.

4. The waveguide assembly of claim 1, wherein, in the first orientation, each of the free ends of the front panels abuts a first surface at the free end of an associated one of the rear panels, and, in the second orientation, each of the fee ends of the front panels abuts a second surface at the free end of the associated one of the rear panels.

5. The waveguide assembly of claim 1, further comprising a plurality of springs which bias the displaceable panels towards the first orientation.

6. The waveguide assembly of claim 1, wherein the plurality of panels includes a first plurality of panels that form a first sidewall of the waveguide, and a second plurality of panels that form a second sidewall of the waveguide.

7. The waveguide assembly of claim 6, wherein each of the first and second plurality of panels includes a rear panel, a main panel, and a front panel, and wherein the main panels at least partially define a primary flare of the waveguide, and the front panels at least partially defines a secondary flare of the waveguide.

8. The waveguide assembly of claim 7, wherein, in each of the first and second plurality of panels, the front panel is coupled to the main panel at a first hinge and the main panel is coupled to the rear panel a second hinge.

9. The waveguide assembly of claim 1, wherein the panels are removably received between the trays.

10. The waveguide assembly of claim 9, wherein the panels are configured to be removed, reoriented, and reinserted to adjust the coverage pattern of the waveguide.

11. The waveguide assembly of claim 10, wherein each of the panels includes a first surface that defines a first coverage angle and a second surface that defines a second coverage angle.

12. The waveguide assembly of claim 11, wherein the panels are configured to be arranged in a first orientation in which the respective first surfaces of the left and right panels face each other to provide a first coverage pattern and a second orientation in which the respective second surfaces of the left and right panels face each other to provide a second coverage pattern that is narrower than the first coverage pattern.

13. A waveguide assembly for a loudspeaker, the waveguide assembly comprising:

a plurality of panels; and a plurality of trays, which together with the plurality of panels at least partially defines a waveguide, wherein the plurality of panels includes a first plurality of panels that form a first sidewall of the waveguide and a second plurality of panels that form a second sidewall of the waveguide, and the first and second pluralities of panels are moveable between a first orientation providing a first coverage pattern and a second orientation providing a second coverage pattern that is narrower than the first coverage pattern by sliding the panels fore and aft relative to the trays.

14. The waveguide assembly of claim 13, wherein side edges of the panels are slidably received in tracks defined by the trays, and wherein the panels are moveable between the first orientation and the second orientation by sliding the panels fore and aft relative to the trays.

15. The waveguide assembly of claim 14, wherein the first and second pluralities of panels may be positioned in a third orientation that provides a third coverage pattern that is narrower than the first coverage pattern and wider than the second coverage pattern by sliding the panels fore and aft relative to the trays.

16. A waveguide assembly for a loudspeaker, the waveguide assembly comprising:

a plurality of panels; and a plurality of trays, which together with the plurality of panels at least partially defines a waveguide, wherein the plurality of panels includes a first plurality of panels that form a first sidewall of the waveguide and a second plurality of panels that form a second sidewall of the waveguide, and the one or more of the panels arranged to be movable comprise displaceable panels, and further comprising one or more motors coupled to the displaceable panels.

17. The waveguide assembly of claim 16, further comprising a controller coupled to the one or more motors and configured to provide control signals to the one or more motors to actuate the one or more motors to move the displaceable panels.

18. The waveguide assembly of claim 17, further comprising one or more sensors coupled to the controller and configured to detect the relative position of the displaceable panels and to provide sensor signals to the controller.

* * * * *